US006335516B1

(12) United States Patent
Müller et al.

(10) Patent No.: US 6,335,516 B1
(45) Date of Patent: Jan. 1, 2002

(54) CERAMIC HEATING ROD AND GLOW PLUG CONTAINING THE LATTER AND A PROCESS FOR THEIR MANUFACTURE

(75) Inventors: Helmut Müller, Besigheim; Jens Hillius, Steinach, both of (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 09/608,224

(22) Filed: Jun. 30, 2000

(30) Foreign Application Priority Data

Jul. 2, 1999 (DE) ..... 199 30 334

(51) Int. Cl.[7] ..... F23Q 7/00
(52) U.S. Cl. ..... 219/270; 219/544; 123/145 A
(58) Field of Search ..... 219/270, 544; 123/145 A, 145 R; 361/264–266

(56) References Cited

U.S. PATENT DOCUMENTS 5,519,187 A * 5/1996 Hinkle ..... 219/270
5,852,280 A * 12/1998 Mizuno ..... 219/270
5,893,993 A * 4/1999 Kurano ..... 219/270
6,111,223 A * 8/2000 Tatematsu ..... 219/270

FOREIGN PATENT DOCUMENTS

JP 7-6865 * 1/1995
JP 9-184622 * 7/1997

* cited by examiner

*Primary Examiner*—John A. Jeffery
(74) *Attorney, Agent, or Firm*—Nixon Peabody LLP; David S. Safran

(57) ABSTRACT

Heating rod with a heating element of electrically conductive ceramic material which has a heating area which is U-shaped in the lengthwise section integrally adjoining a pair of conductors, the heating element (1*a*) being embedded in a heating rod body (1*b*) of electrically insulating ceramic mass(3).

12 Claims, 4 Drawing Sheets

CERAMIC HEATING ROD AND GLOW PLUG CONTAINING THE LATTER AND A PROCESS FOR THEIR MANUFACTURE

BACKGROUND OF THE INVENTION

1. Field of the Invention

The invention relates to a heating rod with a heating element of conductive ceramic material, glow plugs with one such heating rod, and a process for their manufacture.

2. Description of the Related Art

A heating rod with a heating element of conductive ceramic material is known from DE 4117253 A1. Here the heating section aligned unsupported on the tip of a hollow holder to the outside is mounted in a glow plug body, an insulating layer being inserted between the conductor sections which correspond to the front end area of the holder of the ceramic heater and being securely fitted there. The conductor sections and the insulating layer are connected via a brazing solder filler metal which consists of a Cu—Al—Ti alloy. The use of various insulating layers of different materials and the necessity of bonding and binding layers lead to a complex structure of this glow plug.

SUMMARY OF THE INVENTION

The primary object of the invention is to make available a heating rod with a heating element of electrically conductive ceramic material and rod glow plugs with one such heating rod, and simple production processes of the heating rod will enable mass production, while at the same time high serviceability and dimensional accuracy as well as a compact design of the heating rod or rod glow plug will be attainable.

This, as well as other objects in accordance with the present invention is achieved by the heating rod with a heating element of electrically conductive ceramic material which has a heating area which is U-shaped in the lengthwise section integrally adjoining a pair of conductors, characterized in that the heating element is embedded in a heating rod body of electrically insulating ceramic mass, the heating element being made as a U-shaped component in the lengthwise section and being produced by an injection molding process, and being extrusion-coated with an insulating ceramic with the formation of the heating rod body.

DETAILED DESCRIPTION OF THE INVENTION

Figure 1:
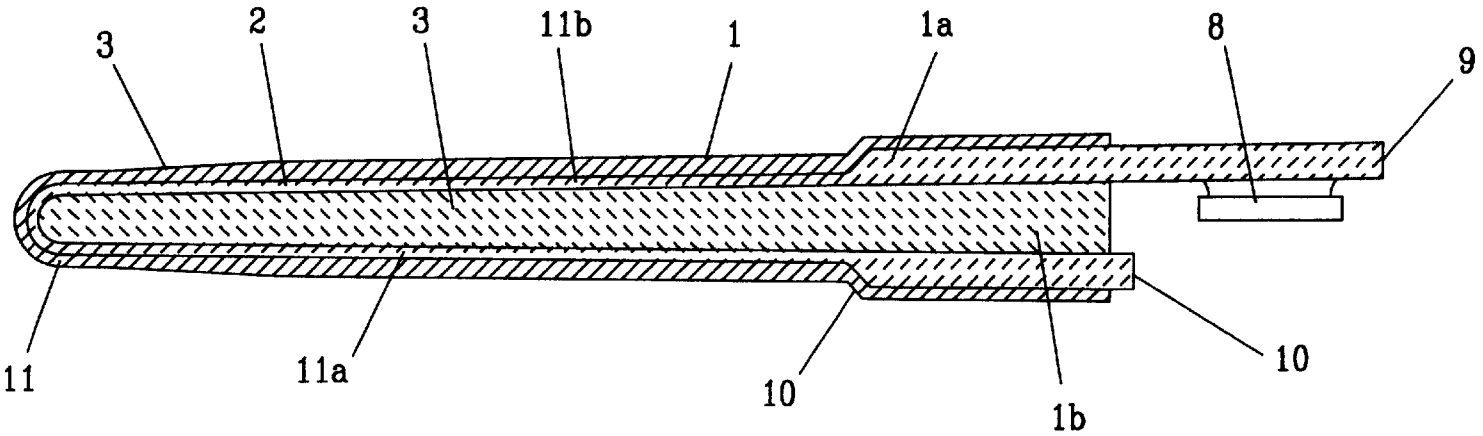
FIG. 1 is a schematic lengthwise section through one embodiment of the heating rod in accordance with the present invention.

As shown in FIG. 1, one embodiment of a heating rod in accordance with the present invention, as is intended for a rod glow plug, has a conventional, corresponding external shape. It has a heating element 1*a* which is made as a U-shaped component (see FIGS. 5*a* and 5*b*) or as a sleeve-shaped component (see FIG. 6); this heating element 1*a* in the heating area 11 has an area which is bent in a U-shape (see FIGS. 5*a*/5*b*) or an area with the shape of a hemispherical shell with integrally adjoining areas 11*a* and 11*b* which are made rod-shaped (see FIGS. 5*a*/5*b*) or sleeve-shaped (see FIG. 6) and likewise consist of the same conductive ceramic material 2.

The heating element 1*a* is covered on all sides by an insulating ceramic mass 3 and is intimately connected to it, preferably without any additional intermediate layer; the insulating ceramic mass 3 forms the heating rod body 1*b* in which the heating element 1*a* is embedded.

On the end of the heating rod facing away from the heating area 11 the supply lines 11*a*/11*b* emerge from the heating rod body 1*b* and form the contact surfaces 9. Here an area of the lines 11*a* or 11*b* can also be made as a support base for an electronic component 8. This electronic component 8 can be used for purposes of diagnosis, sensor technology or triggering of the heating element 1*a*.

The sealing surface 10 is made for sealed fitting into the rod glow plug body which is not shown.

The heating element 1*a* is produced preferably by injection molding processes in which the corresponding mold is filled with a conductive ceramic 2. Then the spray-coated part 1*a* is extrusion-coated with insulating ceramic 3. It is especially advantageous if these working steps take place in one unit by multicomponent injection molding processes in two successive steps. Here the conductive ceramic mass consists for example of a Sialon powder which is mixed with duroplastic resin or a thermoplastic mass to form an injectable mass.

The fillers which are necessary for the injection process are then removed by heat treatment from the injected part which was produced here from the 2 components and thus into a compact ceramic raw part which can be finished mechanically, for example, by grinding, before final firing.

The heating area 11 can be positioned in a controlled manner in the tip of the heating rod by the dimensioning of the thickness of the lines 11*a*/11*b*, i.e. by the variable cross sectional surface of the heating element 1*a*; in the terminal area on the other hand the cross section is increased in order to yield a heating power as low as possible there.

Figure 2:
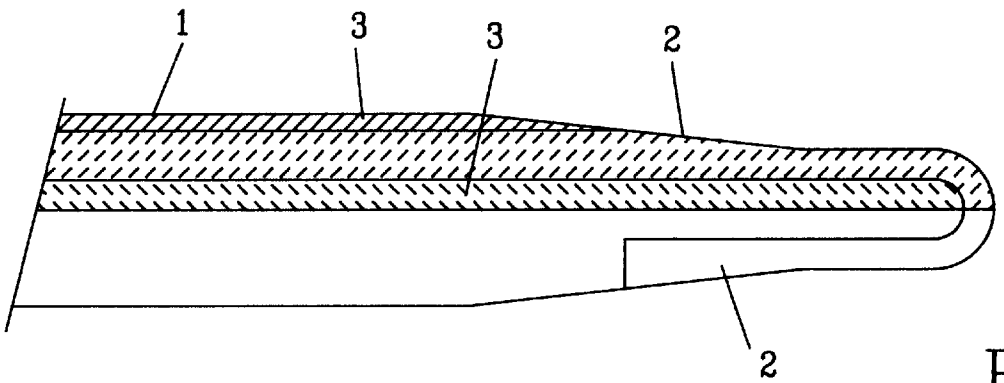
FIG. 2 is a schematic lengthwise section through the tip of another embodiment of a heating rod in accordance with the present invention.

FIG. 2 schematically shows the tip area of another embodiment in accordance with the present invention of the heating rod in accordance with the present invention. Here the heating area 11 is kept free of the insulating ceramic 3 in the area of the heating element 1*a* which points to the outside so that the conductive ceramic mass 2 is exposed; this is especially advantageous when the heating rod in accordance with the present invention is used for ionization measurement. In addition, the heat-up behavior can be improved by this measure since the insulating ceramic 3 which has been eliminated need not be heated up in this area. It is especially advantageous if the conductive ceramic 2 is exposed only at the tip of the heating rod on the surface because additional insulation for example with glazing in the installation area is thus no longer necessary.

Figure 3:
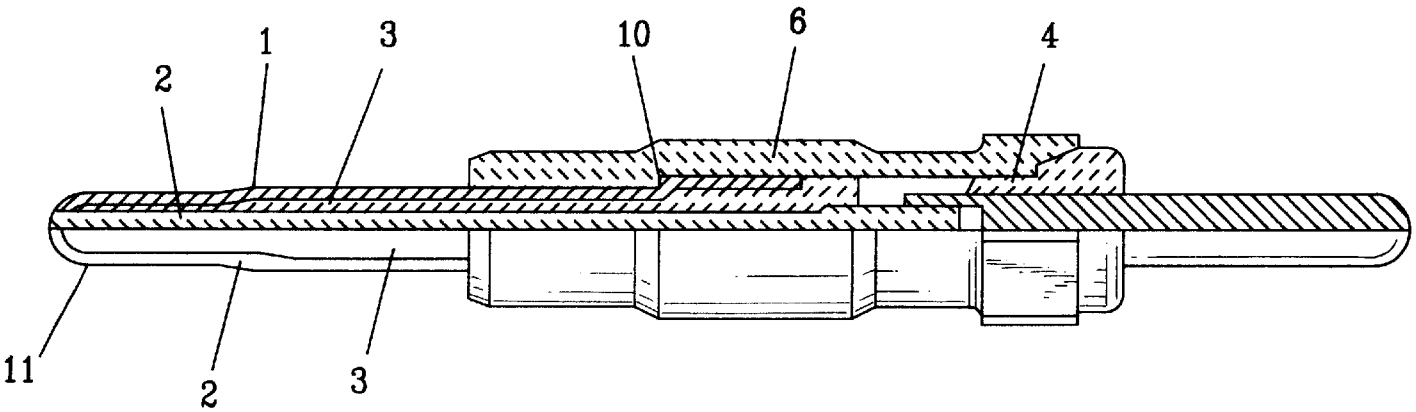
FIG. 3 is a schematic side view with a partial lengthwise section of another embodiment of a heating rod in accordance with the present invention, located in a rod glow plug body.

FIG. 3 shows another embodiment of a heating rod in accordance with the present invention as a component of a single-pin rod glow plug, the heating element 1*a* in the heating area 11 being exposed on the surface of the heating rod. Here the heating element 1*a* is made such that the feed of the glow current into the tip of the heating rod takes place via a central supply line with a relatively large cross section; from the tip of the heating rod it is conducted via the heating area 11 to the jacket surface on the glow plug body 6 which is thus used as a frame terminal. Here the heating area can cover the entire surface or can be divided into one or more segments which are interrupted by insulating ceramic 3.

The electrical terminal of the heating element 1 a can for example be routed to the outside by compressive contact-making via a connector 4. The frame terminal is made such that on the sealing surface 10 the conductive ceramic is exposed at least in sections and in this way the electrical connection to the metallic body 6 is established via which the heating element 1*a* makes contact to ground so that a single-pin version of one such plug results which can be made as a glow plug for a diesel engine or a heater.

Figure 4:
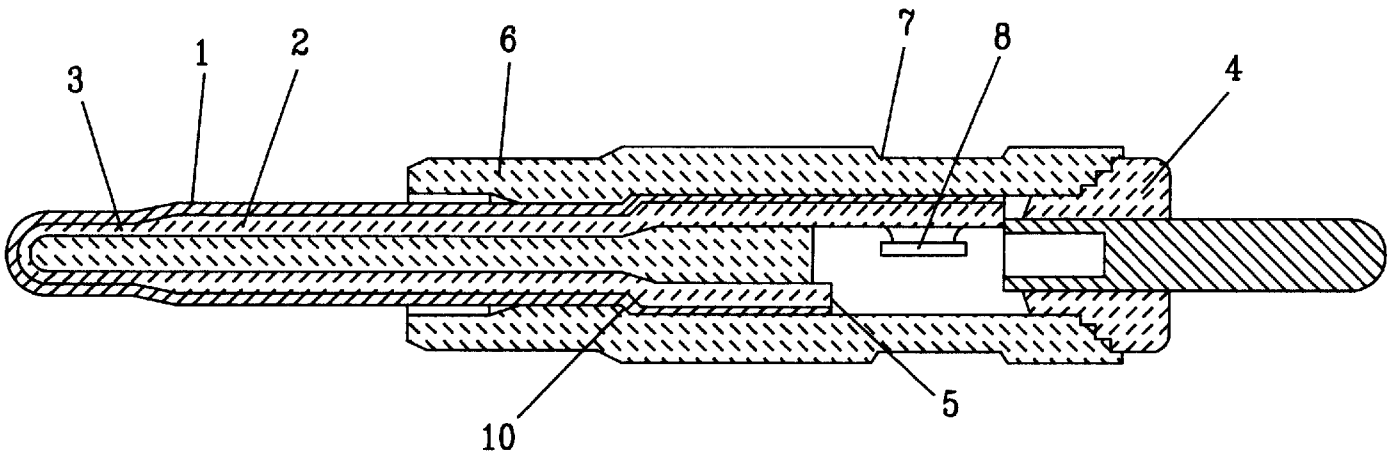
FIG. 4 is a schematic lengthwise section through another embodiment of an arrangement as shown in FIG. 3 with the heating rod in accordance with the present invention.

Another embodiment of a glow plug in accordance with the present invention is shown schematically in FIG. 4. Here the heating rod as shown in FIG. 1 is inserted in the glow plug body 6. The heating element 1*a* is also surrounded in the installation area into the body 6 with insulating ceramic 3 so that making of contact with the body 6 is precluded. The terminal areas 5 and 7 are connected to an electronic component 8, part of the heating element 1*a* being used at the same time as the carrier for the electronic component 8. With this electronic component 8 the heating element 1*a* can be controlled, cycled, or switched between glow and measurement operation. If the glow plug is used via the electronic component 8 to measure ionization, the heating rod, as is described for example in FIG. 2, is configured such that at least in one partial area the conductive ceramic layer 2 is exposed at a point which is suitable for the measurement.

Figure 5A:
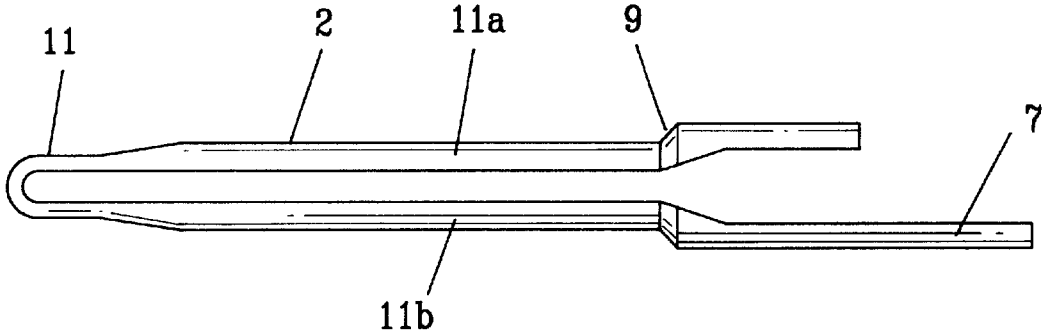
FIGS. 5*a* and 5*b* show two production stages of one embodiment of a heating rod in accordance with the present invention.

FIG. 5*a* shows a schematic side view of a heating element 1*a* of a heating rod embodiment in accordance with the present invention, for example according to FIG. 1. This component is produced in a first production stage in an injection molding process and is made with an extension of the leg 11*b* as a carrier 7 for an electronic component 8.

Figure 5B:
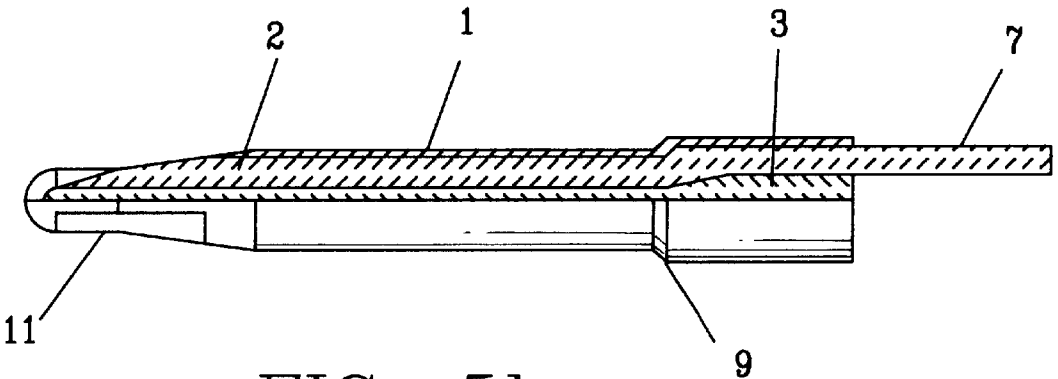

This element is ultimately extrusion-coated in the subsequent production step 2 as shown in FIG. 5*b* with insulating ceramic 3 into the final form with the formation of the heating rod body 1*b* so that the heating element 1*a* is embedded in the heating rod body 1*b*. It is especially advantageous if this second production stage is carried out by a second injection unit in the same tool after the corresponding tool slides are pulled and the mold cavity is cleared for the second production stage.

After extrusion coating, fillers are removed from the product by temperature treatment; the ceramic components 1 and 2 are sintered together to form a solid unitary component by final firing. If necessary the surface of the heating rod can be finished for example on the sealing shoulder by grinding or glazing.

Figure 6:
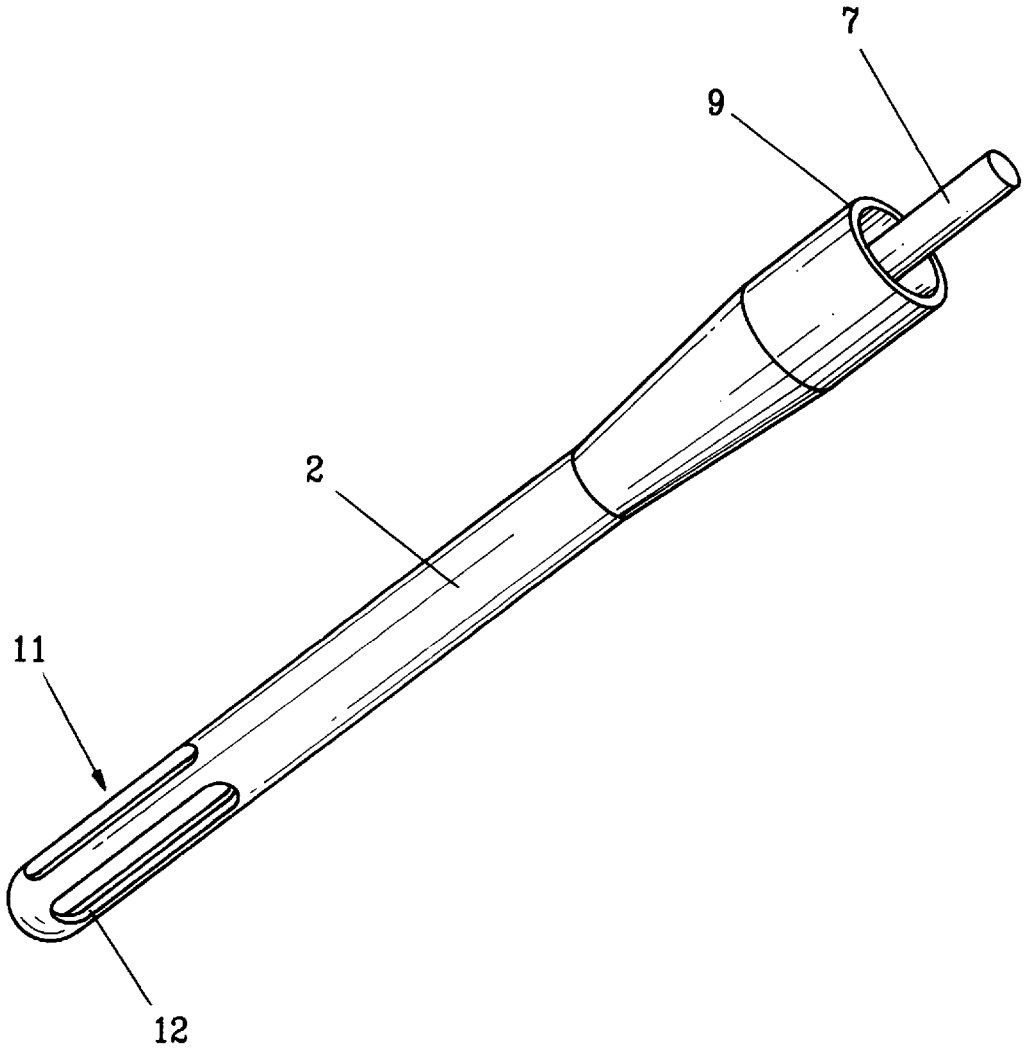
FIG. 6 is a schematic oblique view of another embodiment of a heating element of an heating rod in accordance with the present invention.

As shown in FIG. 6, the heating element 1*a* can be made of a conductive ceramic mass 2 also in the shape of a sleeve, in this embodiment a central supply line 7 for the glow current being provided which is preferably likewise formed from the conductive ceramic mass 2. In the embodiment shown the contact surface 9 is made ring-shaped.

In the heating area 11 this heating element 1*a* can have openings 12 which on the one hand cause better filling of the internal cavity of the heating element 1*a* upon final extrusion coating with the insulating ceramic 3 and on the other hand reduce the cross section of the sleeve-shaped conductor; in this way the electrical resistance of the heating element 1*a* can be increased in this area in a controlled manner so that more rapid heating occurs here.

What is claimed is:

1. Heating rod with a heating element of electrically conductive ceramic material which has a heating area which is U-shaped in the lengthwise section integrally adjoining a pair of conductors, characterized in that the heating element (1*a*) is embedded in a heating rod body (1*b*) of electrically insulating ceramic mass (3), the heating element (1*a*) being made as a U-shaped component in the lengthwise section and being produced by an injection molding process, and being extrusion-coated with an insulating ceramic (3) with the formation of the heating rod body (1*b*).

2. Heating rod as claim 1, wherein the heating element (1*a*) is made sleeve-shaped and is produced by an injection molding process, and is extrusion-coated with an insulating ceramic (3) with the formation of the heating rod body (1*b*).

3. Heating rod as claimed in claim 2, wherein there are openings (12) in a heating area (11) of the heating element.

4. Heating rod as claimed in 2 or 3, wherein the end section of the sleeve-shaped heating element 1*a* is made as a terminal tube section with a contact surface 9, while the supply line to the tip of the heating element is routed centrally through the sleeve.

5. Heating rod as claimed in claim 4, wherein the U-shaped bend of the heating element (1*a*) in the heating area (11) of the heating rod on its outside surface is kept free of the insulating ceramic mass (3).

6. Heating rod as claimed in claim 5, wherein the heating element (1*a*), exposed with its surface which points to the outside, is embedded in the heating rod body (1*b* ), and includes a central current supply line with a comparatively large cross section, said supply line being formed from of an electrically conductive ceramic mass (2).

7. Heating rod as claimed in claim 1, wherein one leg (11*b*) of the heating element (1*a*) is routed out of the heating rod body (1*b*) as a terminal (5), this area or the leg (11*a*) which is routed out likewise from the heating rod body (1*b*) being made as a carrier of an electronic component (8).

8. Process for producing a heating rod as claimed in at least one of claims 1 to 7, wherein the heating element (1*a*) is produced from electrically conductive ceramic material (2) and then is extrusion-coated by extrusion coating with an electrically insulating ceramic mass (3) to the heating rod body (1*b*) and the heating element (1*a*) which is embedded therein.

9. Process as claimed in claim 8, wherein the process is carried out in a tool with two injection units in a multicomponent injection molding process.

10. Process as claimed in claim 8 or 9, wherein after extrusion coating, the heating rod formed is temperature treated and the ceramic components are sintered together into a solid, unitary material by firing.

11. A rod glow plug comprising:

a glow plug body (6); and a heating rod, said heating rod having a heating element (1*a*) of electrically conductive ceramic material (3) which has a heating area which is U-shaped in the lengthwise section integrally adjoining a pair of conductors, wherein the heating element (1*a*) is embedded in the heating rod body (1*b*) of electrically insulating ceramic mass (3), the heating element (1*a*) being made as a U-shaped component in the lengthwise section and being produced by an injection molding process, and being extrusion-coated with an insulating ceramic (3) with the formation of the heating rod body (1*b*).

12. Rod glow plug as claimed in claim 11, wherein within the glow plug body (6) on the surface of one leg (11*a*/11*b*) of the U-shaped heating element (1*a*), the rod glow plug has an electronic component for measuring, controlling or cycling the current which passes through the terminal leg.

* * * * *